US007918176B2

(12) United States Patent
Simard et al.

(10) Patent No.: US 7,918,176 B2
(45) Date of Patent: Apr. 5, 2011

(54) WATERCRAFT BUMPER

(75) Inventors: Richard Simard, St-Charles de Drummond (CA); Jonathan Lauzier, Sherbrooke (CA)

(73) Assignee: Bombardier Recreational Products Inc., Valcourt (CA)

( * ) Notice: Subject to any disclaimer, the term of this patent is extended or adjusted under 35 U.S.C. 154(b) by 298 days.

(21) Appl. No.: 12/241,471

(22) Filed: Sep. 30, 2008

(65) Prior Publication Data

US 2010/0077953 A1 Apr. 1, 2010

(51) Int. Cl.
*B63B 59/02* (2006.01)

(52) U.S. Cl. ..... 114/219

(58) Field of Classification Search ..... 114/219
See application file for complete search history.

(56) References Cited

U.S. PATENT DOCUMENTS

| | | | | |
|---|---|---|---|---|
| 4,970,980 | A * | 11/1990 | Eisner | 114/219 |
| 5,743,204 | A | 4/1998 | Tweet | |
| 6,349,662 | B1 * | 2/2002 | Limansky et al. | 114/219 |
| 6,776,114 | B2 * | 8/2004 | Abe | 114/88 |
| 6,843,192 | B1 | 1/2005 | Nugteren et al. | |
| 7,036,447 | B2 * | 5/2006 | Tsumiyama et al. | 114/219 |
| 2004/0200397 | A1 * | 10/2004 | Klein | 114/219 |

* cited by examiner

*Primary Examiner* — Stephen Avila
(74) *Attorney, Agent, or Firm* — Olser, Hoskin & Harcourt LLP

(57) ABSTRACT

A watercraft bumper has an elongate body. The elongate body has a generally C-shaped cross-section. A protrusion extends from one of the end portions of the cross-section and extends towards the other end portion. A watercraft having the bumper is also disclosed. The watercraft has a lip over which the bumper is disposed. The lip has a depression formed in an upper side thereof. The protrusion of the bumper is disposed in the depression and is biased against the upper side.

19 Claims, 9 Drawing Sheets

WATERCRAFT BUMPER

FIELD OF THE INVENTION

The present invention relates to a bumper for covering the connection between the hull and the deck of a watercraft.

BACKGROUND OF THE INVENTION

Many watercraft, such as personal watercraft, have a hull and a deck supported by the hull. The deck is typically bonded to the hull. The portion of the watercraft where the hull and the deck are joined forms a lip and is typically, at least in personal watercraft, the outermost portion of the watercraft. This portion is therefore the most likely to make contact with objects such as a dock. In order to protect the lip of the watercraft, a bumper, also known as a rub rail or an edge trim piece, is disposed over the lip. The bumper also provides a more aesthetic appearance to the watercraft.

FIG. 6 illustrates a cross-section of a prior art bumper 300 installed to the portion where the deck 302 is joined to the hull 304. In order to install the bumper 300, holes first need to be drilled in the deck 302 and the hull 304. Fasteners 306, such as rivets, are then used to fasten the channel-shaped main portion 308 of the bumper 300. An insert piece 310 is then disposed in the channel-shaped main portion 308 to hide the fasteners 306.

Although the above-described bumper, and other bumpers of its type, work well to protect the watercraft from impacts with objects, its installation requires many steps (i.e. drilling, fastening, adding the insert piece) which is time consuming.

Other prior art bumpers have replaced the insert piece 310 with a flap integrally formed with the main portion 308, thus reducing the number of parts and installation steps. However, fasteners are nonetheless being used to attach the bumper to the watercraft.

Therefore, there is a need for a watercraft bumper that can be installed more easily.

There is also a need for a watercraft having such a bumper.

SUMMARY OF THE INVENTION

It is an object of the present invention to ameliorate at least some of the inconveniences present in the prior art.

It is also an object of the present invention to provide a watercraft bumper that does not necessarily require the use of fasteners or adhesives to be installed.

It is another object of the present invention to provide a watercraft having the above-described bumper.

In one aspect, the invention provides a watercraft bumper having an elongate body. The elongate body has a cross-section. The cross-section includes a side portion having a first end and a second end, a first end portion connected to the first end and extending away from the side portion, and a second end portion connected to the second end and extending away from the side portion. The side, first, and second end portions form a generally C-shaped channel. A protrusion extends from the first end portion towards the second end portion. The protrusion is spaced from the side portion. A generally bow-shaped portion is connected to at least one of the side portion, the first end portion, and the second end portion. The bow-shaped portion is disposed between the side portion and the protrusion and is spaced from the protrusion.

In an additional aspect, the protrusion has a generally rounded section and a neck section connecting the generally rounded section to the first end portion. The neck section is narrower than the rounded section.

In a further aspect, the cross-section further includes a wall extending from the second end portion towards the first end portion. The bow-shaped portion is disposed between the side portion and the wall. The wall is spaced from the bow-shaped portion.

In an additional aspect, the bow-shaped portion has an apex and two ends. One of the two ends of the bow-shaped portion is connected to the first end portion. An other of the two ends of the bow-shaped portion is connected to the second end portion. The apex is spaced from the side portion.

In a further aspect, the bow-shaped portion has at least one protrusion near the apex.

In an additional aspect, the bow-shaped portion and the side portion form a cavity therebetween.

In a further aspect, the cross-section further includes a curved portion connected to the second end portion. The second end portion is disposed between the curved portion and the first end portion.

In an additional aspect, the curved portion and the second end portion form a cavity therebetween.

In a further aspect, the side portion is a first side portion. The cross-section further includes a second side portion extending from the second end portion towards the first end portion. The wall is disposed between the second side portion and the bow-shaped portion.

In an additional aspect, the second side portion and the curved portion have a continuous curvature.

In a further aspect, the cross-section further includes a curved portion connected to the second end portion. The second end portion is disposed between the curved portion and the first end portion.

In an additional aspect, the side portion is a first side portion. The cross-section further includes a second side portion extending from the second end portion towards the first end portion. The first side portion and the second side portion are disposed at opposite ends of the second end portion.

In another aspect, the invention provides a watercraft having a hull having a hull body and a hull lip connected to the hull body, an engine supported by the hull, a propulsion system operatively connected to the engine, and a deck having a deck body and a deck lip. The deck lip is disposed on the hull lip. The deck and hull lips together forming a watercraft lip. The watercraft lip includes an upper side, a depression formed in the upper side, a lower side disposed below the upper side, and an outer side facing away from the hull body. A bumper is disposed at least in part over the watercraft lip. The bumper has an elongate body. The elongate body has a cross-section. The cross-section includes a side portion having a first end and a second end, an upper portion connected to the first end of the side portion and extending towards the deck body, and a lower portion connected to the second end and extending towards the hull body below the lower side of the watercraft lip. The side portion is disposed such that the watercraft lip is disposed between the side portion and the hull body. The upper portion is disposed above the upper side of the watercraft lip. The lower portion is biased against the watercraft lip. A protrusion extends from the upper end portion towards the upper side of the watercraft lip. The protrusion is disposed in the depression formed in the upper side and is biased against the upper side.

In a further aspect, a straddle-type seat disposed on the deck.

In an additional aspect, the deck lip has a generally horizontal leg and a generally vertical leg extending downwardly from the horizontal leg such that the hull lip is disposed between the vertical leg and the hull body. The generally horizontal leg forms the upper side of the watercraft lip and has the depression formed therein. The generally vertical leg forms the outer side the watercraft lip. The generally vertical leg has an inner side facing towards the hull body and a lower end. The lower portion is biased against the lower end.

In a further aspect, the cross-section further includes a wall extending from the lower portion towards the upper portion. The watercraft lip has an inner side facing towards the hull body. The wall is disposed between the inner side of the watercraft lip and the hull body. The wall is biased against the inner side of the watercraft lip.

In an additional aspect, the cross-section further includes a generally bow-shaped portion connected to at least one of the side, the upper, and the lower portions. The bow-shaped portion is disposed between the side portion and the outer side of the watercraft lip and is biased against the outer side of the watercraft lip.

In a further aspect, the bow-shaped portion has at least one protrusion near the apex.

In an additional aspect, the cross-section further includes a curved portion connected to the lower portion. The lower portion is disposed between the curved portion and the upper portion.

In a further aspect, the side portion of the cross-section is a first side portion. The watercraft lip has an inner side facing the hull body. The cross-section further includes a second side portion extending from the lower portion towards the upper portion and being disposed between the inner side of the watercraft lip and the hull body. At least part of the second side portion abuts against the watercraft lip.

For purposes of this application, unless indicated otherwise (such as for the description of FIG. 7A for example), terms related to spatial orientation such as upper, lower, forwardly, rearwardly, left, and right, are as they would normally be understood by a driver of the watercraft sitting thereon in a normal driving position.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

The present invention will be described with respect to a personal watercraft. However, it should be understood that other types of watercraft are contemplated.

The general construction of a personal watercraft 10 in accordance with aspects of this invention will be described with respect to FIGS. 1-5. The following description relates to one way of manufacturing a personal watercraft. Obviously, those of ordinary skill in the watercraft art will recognize that there are other known ways of manufacturing and designing watercraft and that this invention would encompass other known ways and designs.

Figure 1:
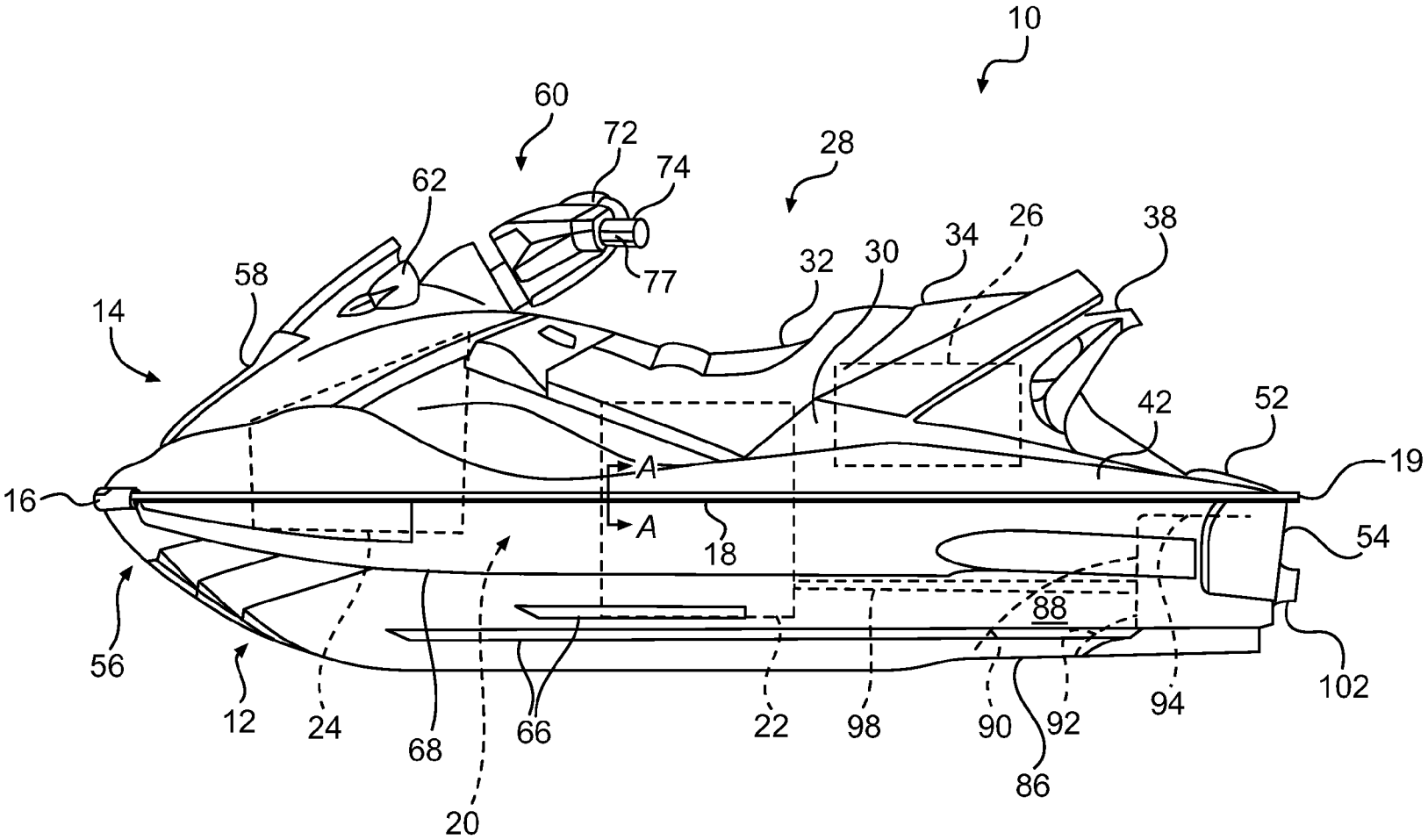
FIG. 1 illustrates a side view of a personal watercraft in accordance with aspects of the invention.

The watercraft 10 of FIG. 1 is made of two main parts, including a hull 12 and a deck 14. The hull 12 buoyantly supports the watercraft 10 in the water. The deck 14 is designed to accommodate a rider and one or more passengers. The hull 12 and deck 14 are sealingly joined together by bonding them with an adhesive, as described in greater detail below. Of course, other known joining methods could be used to sealingly engage the parts together, including but not limited to thermal fusion, molding or fasteners such as rivets or screws. A bumper 16 covers the connection between the hull 12 and the deck 14 at the front of the watercraft 10. Bumpers 18, described in greater detail below, cover the connection between the hull 12 and the deck 14 at the sides of the watercraft 10. A bumper 19 covers the connection between the hull 12 and the deck 14 at the back of the watercraft 10, including the back corners of the connection. The forward ends of bumpers 18 are disposed under the rear ends of the bumper 16. The rear ends of bumpers 18 are disposed adjacent to the forward ends of the bumper 19. The bumpers 16, 18, and 19 help to prevent damage to the outer surface of the watercraft 10 when the watercraft 10 is docked for example.

The space between the hull 12 and the deck 14 forms a volume commonly referred to as the engine compartment 20. Shown schematically in FIG. 1, the engine compartment 20 accommodates an engine 22, as well as an exhaust system, fuel supply system, electrical system (battery, electronic control unit, etc.), air intake system, storage bins 24, 26, and other elements required or desirable in the watercraft 10.

Figure 2:
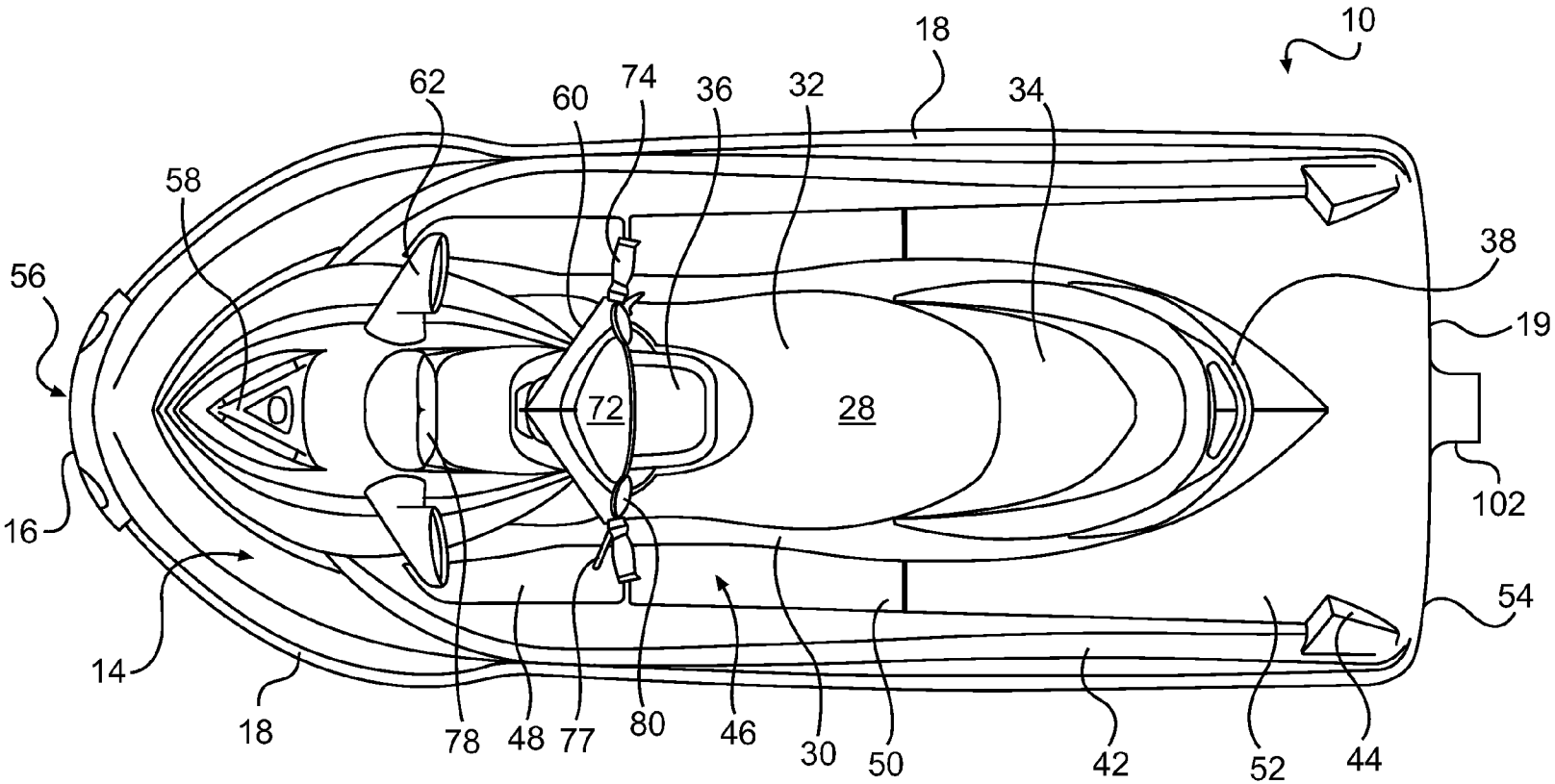
FIG. 2 is a top view of the watercraft of FIG. 1.

As seen in FIGS. 1 and 2, the deck 14 has a centrally positioned straddle-type seat 28 positioned on top of a pedestal 30 to accommodate a rider in a straddling position. The seat 28 is sized to accommodate one or more riders. As seen in FIG. 2, the seat 28 includes a first, front seat portion 32 and a rear, raised seat portion 34 that accommodates a passenger. The first and second seat portions 32, 34 are removably attached to the pedestal 30 by a hook and tongue assembly (not shown) at the front of each seat portion and by a latch assembly (not shown) at the rear of each seat portion, or by any other known attachment mechanism. The seat portions 32, 34 can be individually tilted or removed completely. The seat portion 32 covers an engine access opening (in this case above engine 22) defined by a top portion of the pedestal 30 to provide access to the engine 22 (FIG. 1). The seat portion 34 covers a removable storage box 26 (FIG. 1). A "glove compartment" or small storage box 36 is provided in front of the seat 28.

Figure 4:
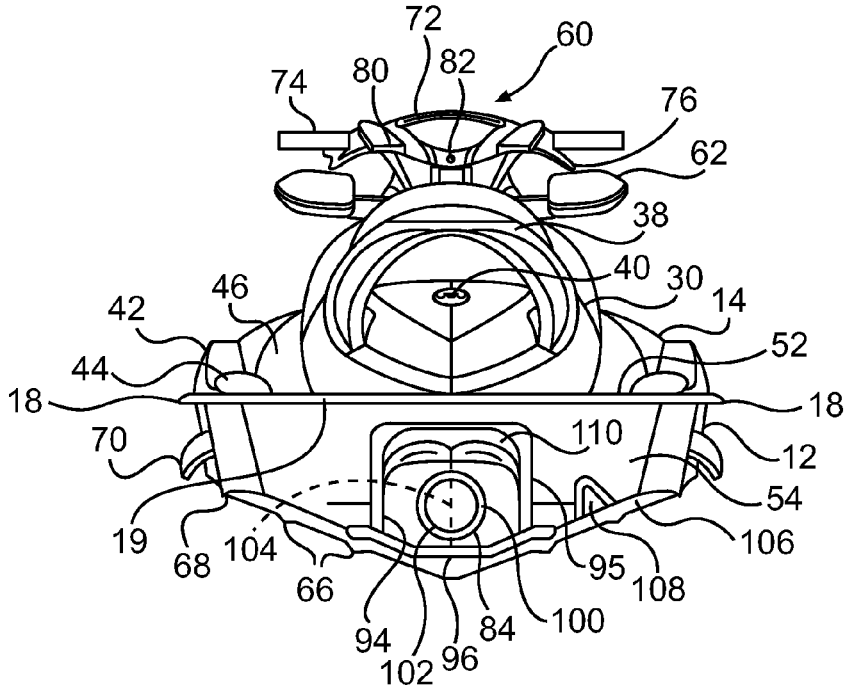
FIG. 4 is a back view of the watercraft of FIG. 1.

As seen in FIG. 4, a grab handle 38 is provided between the pedestal 30 and the rear of the seat 28 to provide a handle onto which a passenger may hold. This arrangement is particularly convenient for a passenger seated facing backwards for spotting a water skier, for example. Beneath the handle 38, a tow hook 40 is mounted on the pedestal 30. The tow hook 40 can be used for towing a skier or floatation device, such as an inflatable water toy.

As best seen in FIGS. 2 and 4 the watercraft 10 has a pair of generally upwardly extending walls located on either side of the watercraft 10 known as gunwales or gunnels 42. The gunnels 42 help to prevent the entry of water in the footrests 46 of the watercraft 10, provide lateral support for the rider's feet, and also provide buoyancy when turning the watercraft 10, since personal watercraft roll slightly when turning. Towards the rear of the watercraft 10, the gunnels 42 extend inwardly to act as heel rests 44. Heel rests 44 allow a passenger riding the watercraft 10 facing towards the rear, to spot a water-skier for example, to place his or her heels on the heel rests 44, thereby providing a more stable riding position. Heel rests 44 could also be formed separate from the gunnels 42.

Located on both sides of the watercraft 10, between the pedestal 30 and the gunnels 42 are the footrests 46. The footrests 46 are designed to accommodate a rider's feet in various riding positions. To this effect, the footrests 46 each have a forward portion 48 angled such that the front portion of the forward portion 48 (toward the bow 56 of the watercraft 10) is higher, relative to a horizontal reference point, than the rear portion of the forward portion 48. The remaining portions of the footrests 46 are generally horizontal. Of course, any contour conducive to a comfortable rest for the rider could be used. The footrests 46 are covered by carpeting 50 made of a rubber-type material, for example, to provide additional comfort and traction for the feet of the riders.

A reboarding platform 52 is provided at the rear of the watercraft 10 on the deck 14 to allow the rider or a passenger to easily reboard the watercraft 10 from the water. Carpeting or some other suitable covering covers the reboarding platform 52. A retractable ladder (not shown) may be affixed to the transom 54 to facilitate boarding the watercraft 10 from the water onto the reboarding platform 52.

Figure 3:
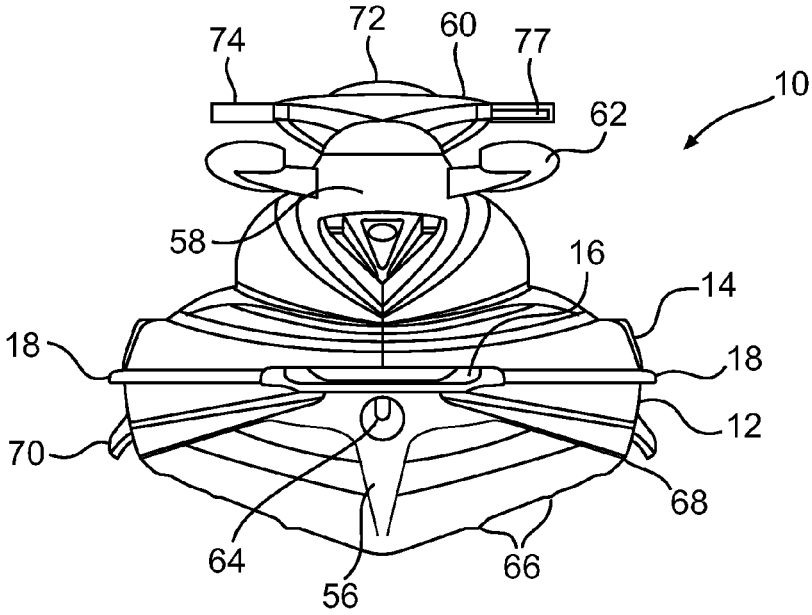
FIG. 3 is a front view of the watercraft of FIG. 1.

Referring to the bow 56 of the watercraft 10, as seen in FIGS. 2 and 3, watercraft 10 is provided with a hood 58 located forwardly of the seat 28 and a steering assembly including a helm assembly 60. A hinge (not shown) is attached between a forward portion of the hood 58 and the deck 14 to allow hood 58 to move to an open position to provide access to the front storage bin 24 (FIG. 1). A latch (not shown) located at a rearward portion of hood 58 locks hood 58 into a closed position. When in the closed position, hood 58 prevents water from entering front storage bin 24. Rearview mirrors 62 are positioned on either side of hood 58 to allow the rider to see behind the watercraft 10. A hook 64 is located at the bow 56 of the watercraft 10. The hook 64 is used to attach the watercraft 10 to a dock when the watercraft is not in use or to attach to a winch when loading the watercraft 10 on a trailer, for instance.

Figure 5:
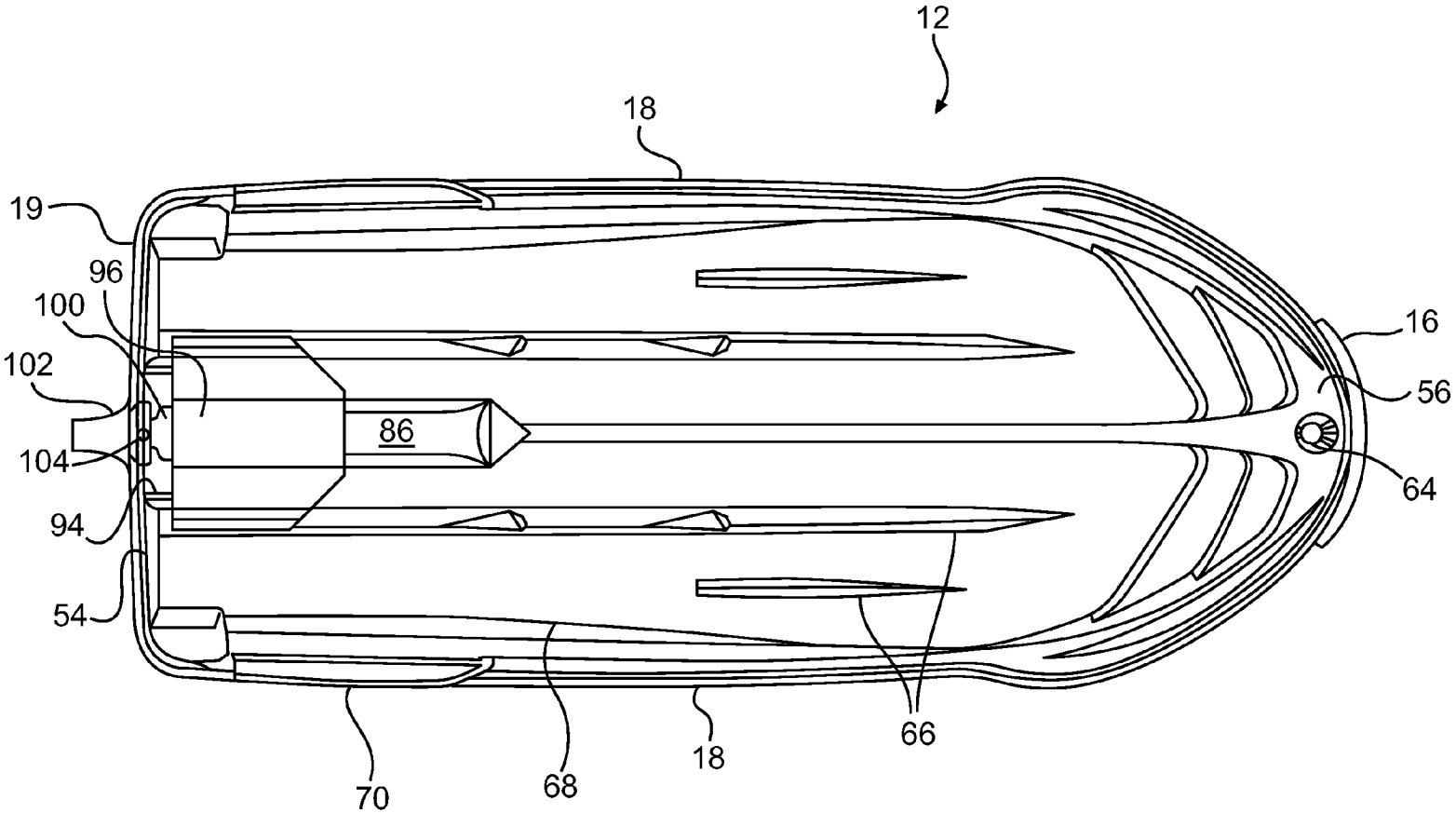
FIG. 5 is a bottom view of the hull of the watercraft of FIG. 1.
Figure 6:
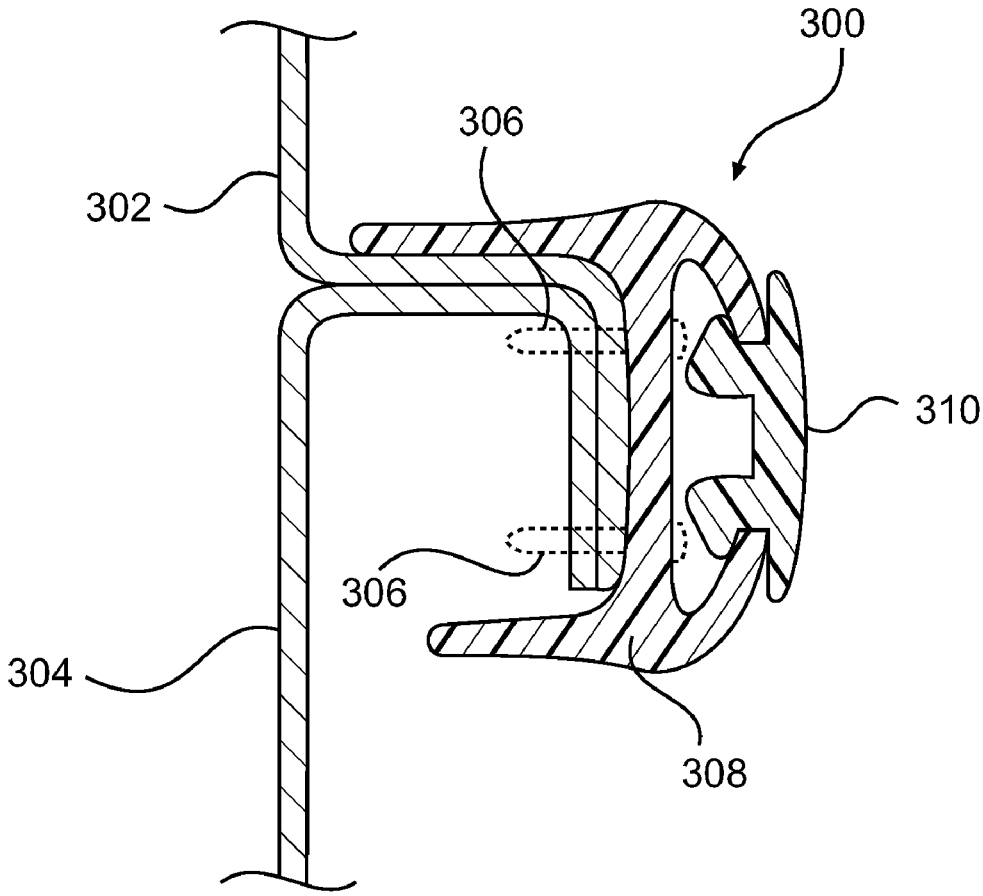
FIG. 6 PRIOR ART
FIG. 6 is a cross-sectional view of a prior art watercraft bumper.

As best seen in FIGS. 3, 4, and 5, the hull 12 is provided with a combination of strakes 66 and chines 68. A strake 66 is a protruding portion of the hull 12. A chine 68 is the vertex formed where two surfaces of the hull 12 meet. The combination of strakes 66 and chines 68 provide the watercraft 10 with its riding and handling characteristics.

Sponsons 70 are located on both sides of the hull 12 near the transom 54. The sponsons 70 have an arcuate undersurface that gives the watercraft 10 both lift while in motion and improved turning characteristics. The sponsons 70 are preferably fixed to the surface of the hull 12 and can be attached to the hull 12 by fasteners or molded therewith. Sometimes it may be desirable to adjust the position of the sponsons 70 with respect to the hull 12 to change the handling characteristics of the watercraft 10 and accommodate different riding conditions.

As best seen in FIGS. 3 and 4, the helm assembly 60 is positioned forwardly of the seat 28. The helm assembly 60 has a central helm portion 72, that may be padded, and a pair of steering handles 74, also referred to as a handlebar. One of the steering handles 74 is provided with a throttle operator 76, which allows the rider to control the engine 22, and therefore the speed of the watercraft 10. The throttle operator 76 can be in the form of a thumb-actuated throttle lever (as shown), a finger-actuated throttle lever, or a twist grip. The throttle operator 76 is movable between an idle position and multiple actuated positions. The throttle operator 76 is preferably biased towards the idle position, such that when the driver of the watercraft lets go of the throttle operator 76, it will move to the idle position. The other of the steering handles 74 is provided with a lever 77 used by the driver to control one of a reverse gate 110 and trim of the watercraft 10.

As seen in FIG. 2, a display area or cluster 78 is located forwardly of the helm assembly 60. The display cluster 78 can be of any conventional display type, including a liquid crystal display (LCD), dials or LEDs (light emitting diodes). The central helm portion 72 has various buttons 80, which could alternatively be in the form of levers or switches, that allow the rider to modify the display data or mode (speed, engine rpm, time . . . ) on the display cluster 78.

The helm assembly 60 also has a key receiving post 82, preferably located near a center of the central helm portion 72. The key receiving post 82 is adapted to receive a key (not shown) that is used to allow starting of the watercraft 10. As is known, the key is typically attached to a safety lanyard (not shown). It should be noted that the key receiving post 82 may be placed in any suitable location on the watercraft 10.

Returning to FIGS. 1 and 5, it can be seen that the watercraft 10 is propelled by a jet propulsion system 84. It is contemplated that other types of propulsion systems could be used. The jet propulsion system 84 pressurizes water to create thrust. The water is first scooped from under the hull 12 through an inlet 86, which preferably has a grate (not shown in detail). The inlet grate prevents large rocks, weeds, and other debris from entering the jet propulsion system 84, which may damage the system or negatively affect performance. Water flows from the inlet 86 through a water intake ramp 88. The top portion 90 of the water intake ramp 88 is formed by the hull 12, and a ride shoe (not shown in detail) forms its bottom portion 92. Alternatively, the intake ramp 88 may be a single piece or an insert to which the jet propulsion system 84 attaches. In such cases, the intake ramp 88 and the jet propulsion system 84 are attached as a unit in a recess in the bottom of hull 12.

From the intake ramp 88, water enters the jet propulsion system 84. The jet propulsion system 84 is located in a formation in the hull 12, referred to as the tunnel 94 (FIG. 1). The tunnel 94 is defined at the front, sides, and top by walls formed by the hull 12 and is opened at the transom 54. The bottom of the tunnel 94 is closed by a ride plate 96. The ride plate 96 creates a surface on which the watercraft 10 rides or planes at high speeds.

The jet propulsion system 84 includes a jet pump (not shown). The forward end of the jet pump is connected to the front wall of the tunnel 94. The jet pump includes an impeller and a stator. The impeller is coupled to the engine 22 by one or more shafts 98 (FIG. 1), such as a driveshaft and an impeller shaft. The rotation of the impeller pressurizes the water, which then moves over the stator that is made of a plurality of fixed stator blades. The role of the stator blades is to decrease the rotational motion of the water so that almost all the energy given to the water is used for thrust, as opposed to swirling the water. Once the water leaves the jet pump, it goes through a venturi 100 that is connected to the rearward end of the jet pump. Since the venturi's exit diameter is smaller than its entrance diameter, the water is accelerated further, thereby providing more thrust. A steering nozzle 102 is rotationally mounted relative to the venturi 100.

The steering nozzle 102 is operatively connected to the helm assembly 60 preferably via a push-pull cable (not shown), such that when the helm assembly 60 is turned, the steering nozzle 102 pivots. This movement redirects the pressurized water coming from the venturi 100, so as to redirect the thrust and steer the watercraft 10 in the desired direction.

The jet propulsion system 84 is provided with a reverse gate 110 (FIG. 4) which is movable between a stowed position where it does not interfere with a jet of water being expelled by the steering nozzle 102 and a plurality of positions where it redirects the jet of water being expelled by the steering nozzle 102. The specific construction of the reverse gate 110 will not be described in detail herein. However it will be understood by those skilled in the art that many different types of reverse gate could be provided without departing from the present invention.

When the watercraft 10 is moving, its speed is measured by a speed sensor 106 attached to the transom 54 of the watercraft 10. The speed sensor 106 has a paddle wheel 108 that is turned by the water flowing past the hull 12. In operation, as the watercraft 10 goes faster, the paddle wheel 108 turns faster in correspondence. An electronic control unit (ECU) (not shown) connected to the speed sensor 106 converts the rotational speed of the paddle wheel 108 to the speed of the watercraft 10 in kilometers or miles per hour, depending on the rider's preference. The speed sensor 106 may also be placed in the ride plate 96 or at any other suitable position. Other types of speed sensors, such as pitot tubes, and processing units could be used, as would be readily recognized by one of ordinary skill in the art. Alternatively, a global positioning system (GPS) unit could be used to determine the speed of the watercraft 10 by calculating the change in position of the watercraft 10 over a period of time based on information obtained from the GPS unit.

The features and the installation of the left bumper 18 will now be described in more detail. The right bumper 18 and its installation will not be described herein as it is merely a mirror image of the left bumper 18. The bumpers 16 and 19 and their installations will not be described in detail herein. It should be understood however that it is contemplated that bumper 16 and 19 could have the same or similar features as bumpers 18 and as such could be installed in the same or a similar way.

Figure 7A:
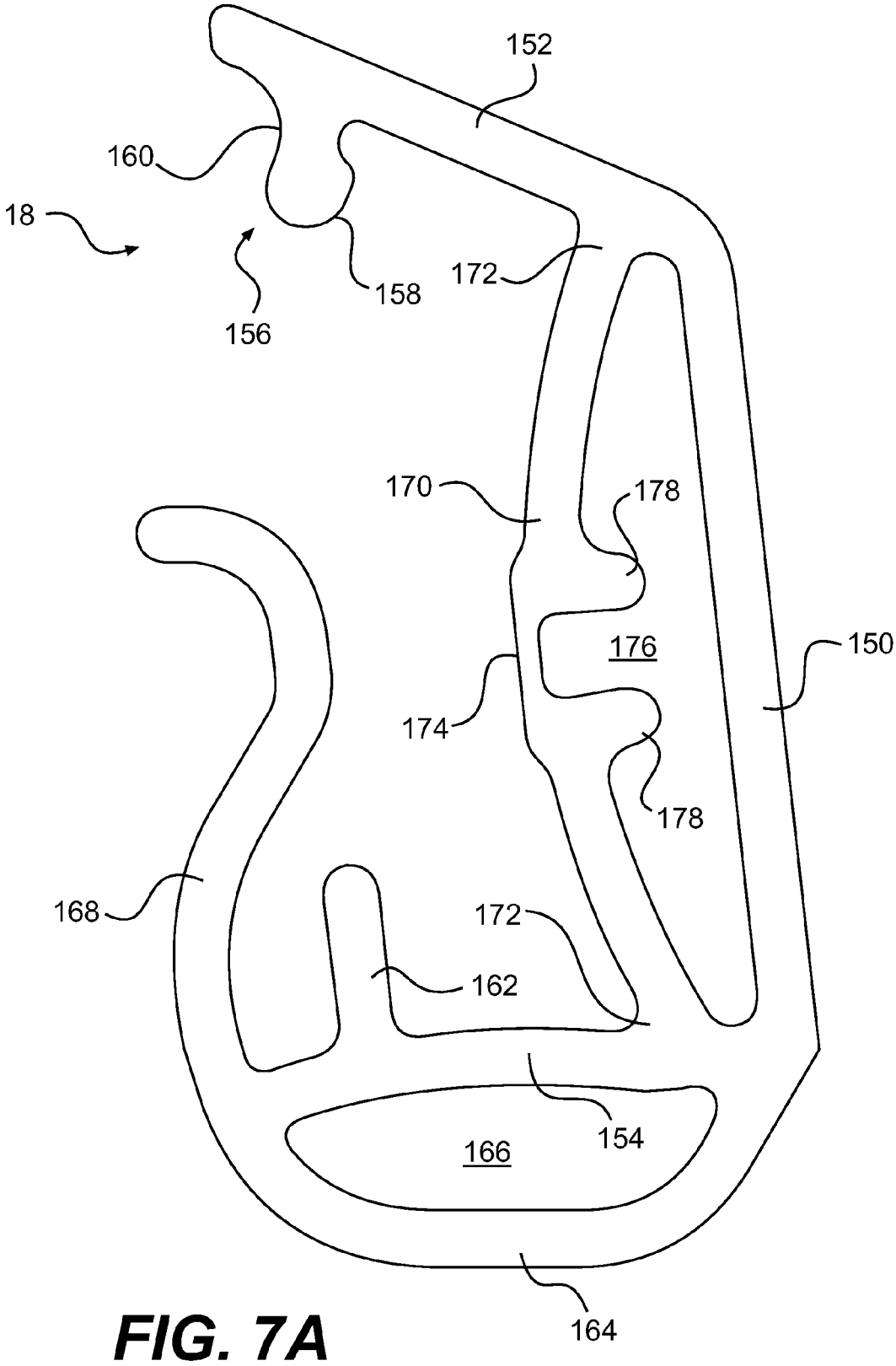
FIG. 7A is a cross-sectional view of a watercraft bumper of the watercraft of FIG. 1.

As can be seen in FIGS. 1, 2, and 5, the bumper 18 has an elongate body that spans almost the whole length of the watercraft 10. Turning to FIG. 7A, the various features of the cross-section (as taken through line A-A of FIG. 1) of the bumper 18 will be described. It should be understood that FIG. 7A illustrates the cross-section of the bumper 18 when the bumper 18 is not installed on the watercraft 10. For simplicity, the disposition of the various features will be described as they would be understood by looking at FIG. 7A. The cross-section has a first side portion 150 that extends generally vertically. An upper portion 152 is connected to the top end of the first side portion 150 and extends to the left thereof. A lower portion 154 is connected to the bottom end of the first side portion 150 and extends to the left thereof. As can be seen, the lower portion 154 has a slight curvature. As can also be seen, the first side portion 150, the upper portion 152, and the lower portion 154 together form a generally (inverted) C-shape.

A protrusion 156 extends downwardly from the upper portion 152 near the left end thereof. The protrusion 156 has a generally rounded section 158 and a narrower neck section 160 that connects the rounded section 158 to the upper portion 152. It is contemplated that the protrusion 156 could have other shapes, such as generally rectangular or hexagonal. A wall 162 extends upwardly from the lower portion 154 near the left end thereof A curved portion 164 is disposed below the lower portion 154. The ends of the curved portion 164 are connected to the ends of the lower portion 154 such that a cavity 166 is formed between the curved portion 164 and the lower portion 154. A second side portion 168 is connected to and extends upwardly from the left end of the lower portion 154. The second side portion 168 has a generally (inverted) S-shape. The curvatures of the second side portion 168 and of the curved portion 164 are such that the transition from one to the other is continuous (i.e. they have a continuous curvature).

Figure 7B:
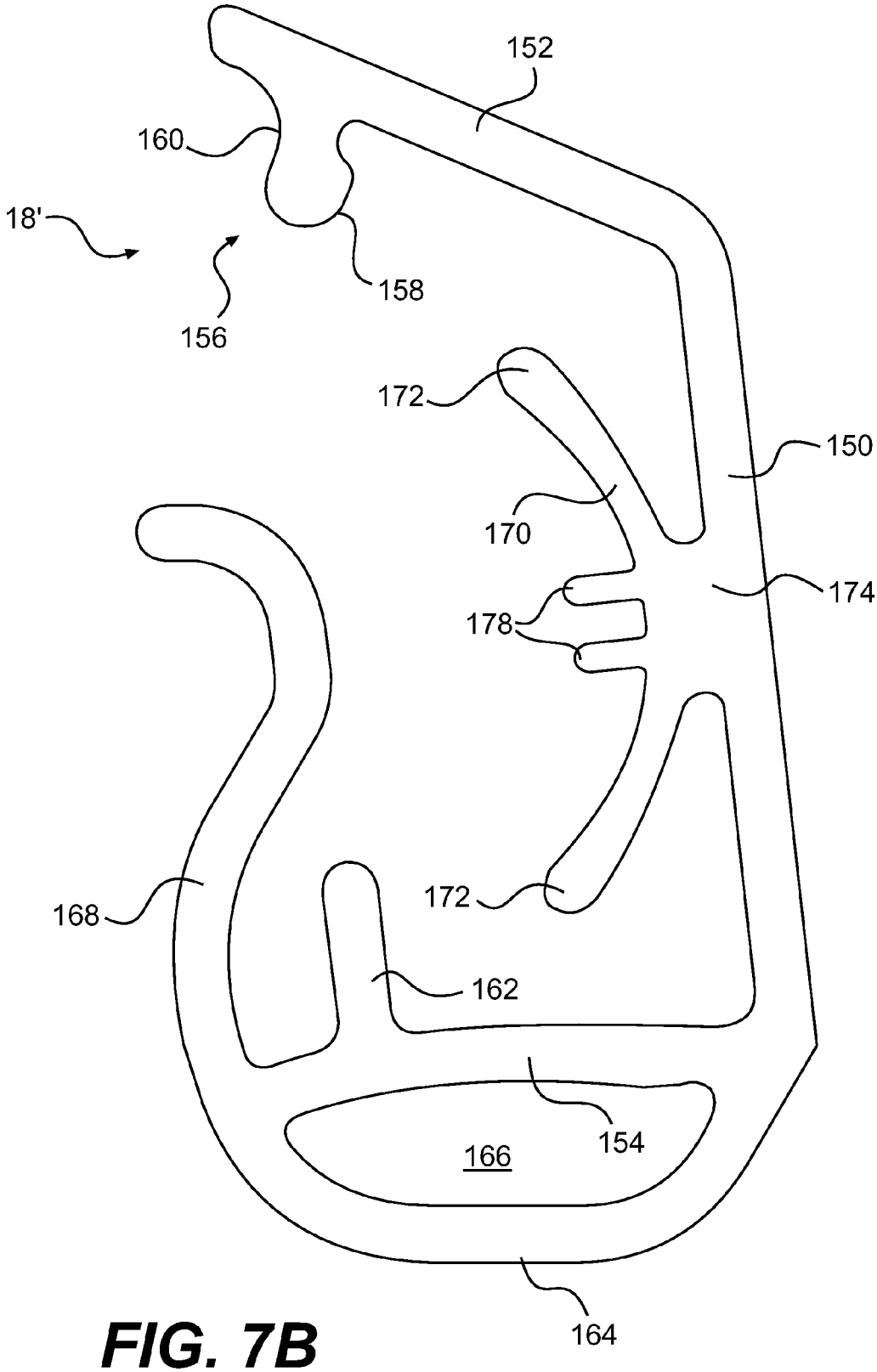
FIG. 7B is a cross-sectional view of an alternative embodiment of the watercraft bumper of the watercraft of FIG. 1.

The cross-section of the bumper 18 also has a bow-shaped portion 170 having two ends 172 and an apex 174. One end 172 is connected to the upper portion 152 near the right end of the upper portion 152. The other end 172 is connected to the lower portion 154 near the right end of the lower portion 154. As a result, the apex 174 of the bow-shaped portion 170 is spaced from the first side wall 150 and a cavity 176 is formed between the bow-shaped portion 170 and the first side portion 150. It is contemplated that one or both of the ends 172 of the bow-shaped section 170 could alternatively be connected to the first side portion 150. It is also contemplated that the bow-shaped portion 170 could be cut through its' apex 174 such that the bow-shaped portion 170 would be made of two segments. Also, as shown in FIG. 7B, it is contemplated that in an alternative embodiment of the bumper 18 (i.e. bumper 18') the apex 174 of the bow-shaped portion 170 could be connected to the first side portion 150 and that the ends 172 of the bow-shaped portion 170 could extend towards the left from the apex 174 and be free of any connection to other parts of the bumper 18'. Returning to FIG. 7A, it can be seen that the bow-shaped portion 170 has a pair of protrusions 178 near the apex 174 that extends towards the first side portion 150. It is contemplated that only one or more than two protrusions 178 could be alternatively be provided.

The bumper 18 is preferably made by extruding high-density polyethylene (HDPE) or polyvinyl chloride (PVC) such that the various parts of the bumper 18 are integrally formed. It is contemplated however that other manufacturing methods and/or materials could be used.

Figure 8:
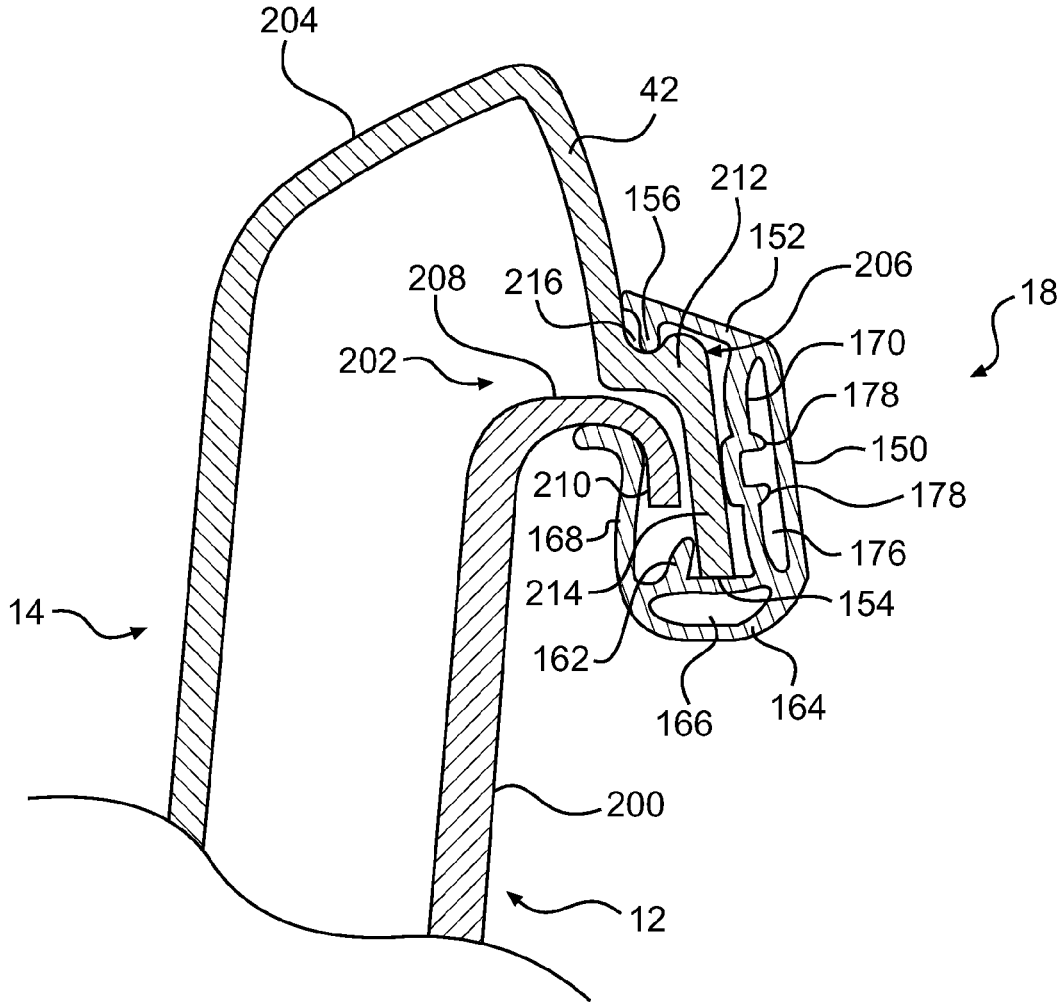
FIG. 8 is a partial cross-sectional of the watercraft of FIG. 1 taken through line A-A of FIG. 1 showing the bumper of FIG. 7A installed on the watercraft.

Turning now to FIG. 8, the connection between the hull 12 and the deck 14 will be described in more detail. As previously described, the deck 14 is disposed on the hull 12 and the two are sealingly joined together. The hull 12 has a hull body 200 and a hull lip 202 connected to and extending from the periphery of the hull body 200. Similarly, the deck 14 has a deck body 204 and a deck lip 206 connected to and extending from the periphery of the deck body 204. The deck lip 206 is disposed over and bonded to the hull lip 202 to provide the sealed joint between the hull 12 and the deck 14. The hull lip 202 and the deck lip 206 together form the watercraft lip. As previously mentioned, other methods could be used to provide the sealed connection between the hull 12 and the deck 14. In the embodiment shown in FIG. 8, the hull lip 202 has a generally horizontal leg 208 and a generally vertical leg 210 extending downwardly from the outer end of the horizontal leg 208. Similarly, the deck lip 206 has a generally horizontal leg 212 and a generally vertical leg 214 extending downwardly from the outer end of the horizontal leg 212. The vertical leg 214 of the deck lip 206 extends downwardly lower than the vertical leg 210 of the hull lip 202. The horizontal leg 212 of the deck lip 206 has a depression 216 formed in an upper surface thereof near the deck body 204. As can be seen, the hull lip 202 is received in the deck lip 206. Adhesive (not shown) is disposed in the gap between the lips 202 and 206 to create the sealed bond. Other configurations of hull and deck lips 202, 206 are contemplated, some of which will be described below with reference to FIGS. 9A to 9E.

Also with reference to FIG. 8, the installation of the bumper 18 onto the watercraft lip will be described. To install the bumper 18 the gap between the protrusion 158 and the second side portion 168 is slid over the hull and deck lips 202, 206 such that the lower end of the vertical leg 214 of the deck lip 206 abuts the part of the lower portion 154 between the wall 162 and the bow-shaped portion 170. As a result, the wall 162 is disposed between the vertical leg 214 of the deck lip 206 and the hull body 200 and the upper part of the second side portion 168 is disposed between the vertical leg 210 of the hull lip 202 and the hull body 200. The first side portion 150 is then pushed towards the vertical leg 214 of the deck lip 206 until the upper portion 152 is over the horizontal leg 212 of the deck lip 206 and the protrusion 156 is disposed in the depression 216. It is contemplated that an adhesive could be added between the bumper 18 and the watercraft lip where the two make contact, although, as explained below, the bias of the bumper 18 against the watercraft lip may be sufficient to retain the bumper 18 onto the watercraft lip. Also, although the bumper 18 eliminates the need for fasteners, it is contemplated that fasteners could nonetheless be used to install the bumper 18 to the watercraft lip.

As can be seen by comparing the bumper 18 as illustrated in FIG. 7A and the bumper 18 as illustrated in FIG. 8, once installed, portions of the bumper 18 deform slightly. This creates biasing forces in various directions between the bumper 18 and the watercraft lip which allow the bumper to be retained on the watercraft lip. The lower portion 154 is biased against the lower end of the vertical leg 214. The upper portion 152 biases the protrusion 156 against the upper side of the horizontal leg 212 (in the depression 216). Thus, the lower portion 154 and the protrusion 156 resist vertical movements of the bumper 18. The bow-shaped portion 170 is biased against the outer side of the vertical leg 214. For bumper 18, it is the apex 174 of the bow shaped portion 170 that makes contact with the outer side of the vertical leg 214. In the case of bumper 18' (FIG. 7B), it is the ends 172 of the bow shaped portion 170 that would make contact with the outer side of the vertical leg 214. The protrusion 156 is laterally biased against the depression 216 as a result of the bias of the bow-shaped portion 178 against the outer side of the vertical leg 214. The lower end of the vertical leg 214 deforms the lower portion 154 which causes the wall 162 to rotate towards the inner side of the vertical leg 214 such that the wall 162 is biased against the inner side of the vertical leg 214. Thus, the bow-shaped portion 170, the protrusion 156, and the wall 162 resist horizontal movements of the bumper 18.

Once the bumper 18 is installed, the second side portion 168 abuts both the horizontal and vertical legs 208, 210 of the hull lip 202 so as to cover the underside of the watercraft lip. The curved portion 164 and the second side portion 168 together provide a smooth handle when the bumper 18 (and lip) of the watercraft 10 is grabbed to move the watercraft 10 manually. The cavity 166 allows the curved portion 164 to be somewhat compliant, thus providing a comfortable grip.

When an object makes contact with the side portion 150 of the bumper 18, the cavity 176 allows the side portion 150 to move inwardly. The bow-shaped portion 170 acts as a leaf spring to absorb the impact. In the case of strong impacts, the side portion 150 moves inwardly until it makes contact with the protrusions 178 which act as shock absorbers, thus preventing damage to the watercraft lip.

Turning now to FIGS. 9A to 9E various alternative configurations of watercraft lips and alternative embodiments of the bumper 18 to fit these watercraft lips will be described. It should be understood that other configurations of watercraft lips are contemplated and that corresponding alternative embodiments of the bumper 18 to fit these watercraft lips are also contemplated. For simplicity, elements of the hull 12, deck 14, and the bumpers 18A to 18E which are similar to those described above have been given the same reference numbers. Also, only the differences between the embodiments in FIGS. 9A to 9E and the embodiment of FIG. 8 will be described. Finally, although not specifically mentioned, it should be understood that the proportions of the bumpers 18A to 18E may be different from those of the bumper 18 in order to accommodate the different configurations of watercraft lips.

Figure 9A:
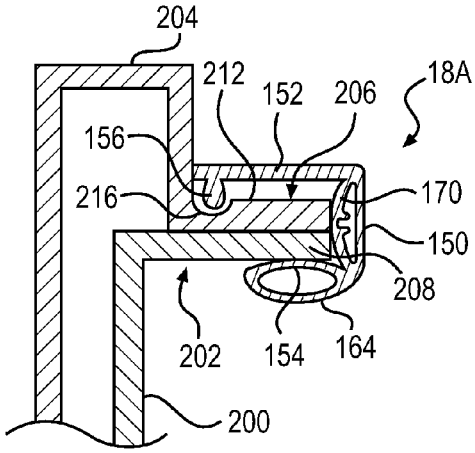
FIGS. 9A to 9E are partial cross-sections of alternative embodiments of bumper and watercraft lip arrangements.

In FIG. 9A, the deck lip 206 only has a horizontal leg 212 and the hull lip 202 only has a horizontal leg 208. As a result, the bumper 18A does not have a second side portion 168 and a wall 162, and the lower portion 154 is biased against the lower side of the horizontal leg 208.

Figure 9B:
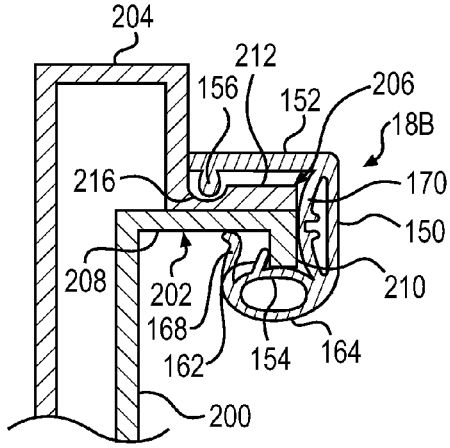

In FIG. 9B, the deck lip 206 only has a horizontal leg 212. The hull lip 202 has a horizontal leg 208 and a vertical leg 210 extending downwardly therefrom. As a result, the bow-shaped portion 170 of the bumper 18B is biased against the outer side of the vertical leg 210, the lower portion 154 is biased against the lower end of the vertical leg 210, and the wall 162 is biased against the inner side of the vertical leg 210.

Figure 9C:
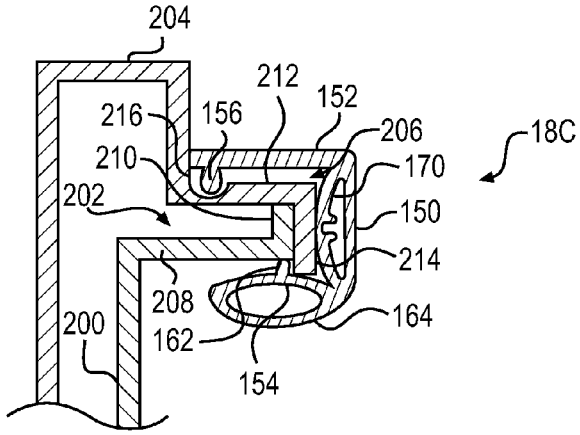

In FIG. 9C, the deck lip 206 has a horizontal leg 212 and a vertical leg 214 extending downwardly therefrom. The hull lip 202 has a horizontal leg 208 and a vertical leg 210 extending upwardly therefrom. The vertical leg 210 is disposed inwardly of the vertical leg 214. As a result, the bumper 18C does not have a second side portion 168, and the wall 162 is shorter.

Figure 9D:
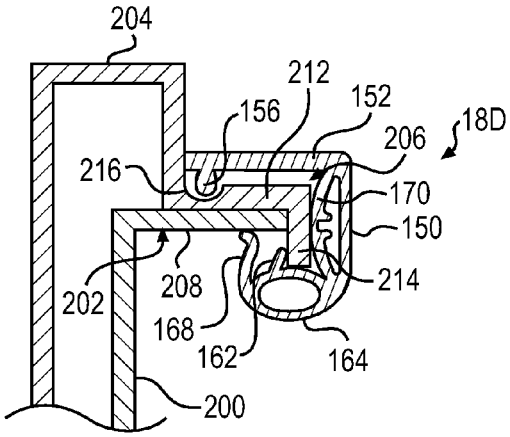

In FIG. 9D, the deck lip 206 has a horizontal leg 212 and a vertical leg 214 extending downwardly therefrom. The hull lip 202 only has a horizontal leg 208. As a result, the second side portion 168 of the bumper 18D abuts both the inner side of the vertical leg 214 and the lower side of the horizontal leg 208.

Figure 9E:
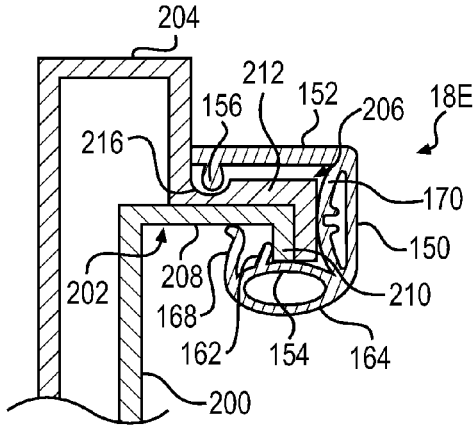

In FIG. 9E, the deck lip 206 has a horizontal leg 212 and a vertical leg 214 extending downwardly therefrom. The hull lip 202 has a horizontal leg 208 and a vertical leg 210 extending downwardly therefrom. In this embodiment, the lower ends of the vertical legs 210, 214 are at the same level. As a result, the lower portion 154 of the bumper 18E is biased against the lower ends of both vertical legs 210, 214 and the wall 162 is biased against the inner side of the vertical leg 210.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A watercraft bumper comprising:

an elongate body, the elongate body having a cross-section, the cross-section including:

a side portion having a first end and a second end;

a first end portion connected to the first end and extending away from the side portion;

a second end portion connected to the second end and extending away from the side portion, the side, first, and second end portions forming a generally C-shaped channel;

a protrusion extending from the first end portion towards the second end portion, the protrusion being spaced from the side portion;

a wall extending from the second end portion towards the first end portion; and a generally bow-shaped portion connected to at least one of the side portion, the first end portion, and the second end portion, the bow-shaped portion being disposed between the side portion and the protrusion and being spaced from the protrusion, the bow-shaped portion being disposed between the side portion and the wall, and the wall being spaced from the bow-shaped portion.

2. The watercraft of claim 1, wherein the protrusion has a generally rounded section and a neck section connecting the generally rounded section to the first end portion; and wherein the neck section is narrower than the rounded section.

3. The bumper of claim 1, wherein the bow-shaped portion has an apex and two ends; and wherein one of the two ends of the bow-shaped portion is connected to the first end portion, an other of the two ends of the bow-shaped portion is connected to the second end portion, and the apex is spaced from the side portion.

4. The bumper of claim 3, wherein the bow-shaped portion has at least one protrusion near the apex.

5. The bumper of claim 3, wherein the bow-shaped portion and the side portion form a cavity therebetween.

6. The bumper of claim 1, wherein the cross-section further includes a curved portion connected to the second end portion; and wherein the second end portion is disposed between the curved portion and the first end portion.

7. The bumper of claim 6, wherein the curved portion and the second end portion form a cavity therebetween.

8. The bumper of claim 6, wherein the side portion is a first side portion;

wherein the cross-section further includes a second side portion extending from the second end portion towards the first end portion; and wherein the wall is disposed between the second side portion and the bow-shaped portion.

9. The bumper of claim 8, wherein the second side portion and the curved portion have a continuous curvature.

10. The bumper of claim 1, wherein the cross-section further includes a curved portion connected to the second end portion; and wherein the second end portion is disposed between the curved portion and the first end portion.

11. The bumper of claim 1, wherein the side portion is a first side portion;

wherein the cross-section further includes a second side portion extending from the second end portion towards the first end portion; and wherein the first side portion and the second side portion are disposed at opposite ends of the second end portion.

12. A watercraft comprising:

a hull having a hull body and a hull lip connected to the hull body;

an engine supported by the hull;

a propulsion system operatively connected to the engine;

a deck having a deck body and a deck lip, the deck lip being disposed on the hull lip, the deck and hull lips together forming a watercraft lip, the watercraft lip including:

an upper side;

a depression formed in the upper side;

a lower side disposed below the upper side; and an outer side facing away from the hull body; and a bumper disposed at least in part over the watercraft lip, the bumper having an elongate body, the elongate body having a cross-section, the cross-section including:

a side portion having a first end and a second end, the side portion being disposed such that the watercraft lip is disposed between the side portion and the hull body;

an upper portion connected to the first end of the side portion and extending towards the deck body, the upper portion being disposed above the upper side of the watercraft lip;

a lower portion connected to the second end and extending towards the hull body below the lower side of the watercraft lip, the lower portion being biased against the watercraft lip; and a protrusion extending from the upper end portion towards the upper side of the watercraft lip, the protrusion being disposed in the depression formed in the upper side and being biased against the upper side.

13. The watercraft of claim 12, further comprising a straddle-type seat disposed on the deck.

14. The watercraft of claim 12, wherein the deck lip has a generally horizontal leg and a generally vertical leg extending downwardly from the horizontal leg such that the hull lip is disposed between the vertical leg and the hull body;

wherein the generally horizontal leg forms the upper side of the watercraft lip and has the depression formed therein;

wherein the generally vertical leg forms the outer side the watercraft lip;

wherein the generally vertical leg has an inner side facing towards the hull body and a lower end; and wherein the lower portion is biased against the lower end.

15. The watercraft of claim 12, wherein the cross-section further includes a wall extending from the lower portion towards the upper portion;

wherein the watercraft lip has an inner side facing towards the hull body;

wherein the wall is disposed between the inner side of the watercraft lip and the hull body; and wherein the wall is biased against the inner side of the watercraft lip.

16. The watercraft of claim 12, wherein the cross-section further includes a generally bow-shaped portion connected to at least one of the side, the upper, and the lower portions; and wherein the bow-shaped portion is disposed between the side portion and the outer side of the watercraft lip and is biased against the outer side of the watercraft lip.

17. The watercraft of claim 16, wherein the bow-shaped portion has at least one protrusion near the apex.

18. The watercraft of claim 12, wherein the cross-section further includes a curved portion connected to the lower portion; and wherein the lower portion is disposed between the curved portion and the upper portion.

19. The watercraft of claim 12, wherein the side portion of the cross-section is a first side portion;

wherein the watercraft lip has an inner side facing the hull body;

wherein the cross-section further includes a second side portion extending from the lower portion towards the upper portion and being disposed between the inner side of the watercraft lip and the hull body; and wherein at least part of the second side portion abuts against the watercraft lip.

* * * * *